United States Patent [19]

Kitchens

[11] Patent Number: 4,746,066

[45] Date of Patent: May 24, 1988

[54] RETROFIT SPRINKLER SYSTEM

[75] Inventor: Chris M. Kitchens, Duluth, Ga.

[73] Assignee: Peachtree Interior Builders, Ltd., Norcross, Ga.

[21] Appl. No.: 22,188

[22] Filed: Mar. 5, 1987

[51] Int. Cl.[4] ..... B05B 15/06; E04B 5/48

[52] U.S. Cl. ..... 239/283; 52/220

[58] Field of Search ..... 239/208, 209, 282, 283; 169/41, 51; 52/220, 221; 248/65, 74.1; 312/209

[56] References Cited

U.S. PATENT DOCUMENTS

| | | | |
|---|---|---|---|
| 910,400 | 1/1909 | Lischer | 239/208 |
| 1,496,402 | 6/1924 | Allen | 239/208 X |
| 2,017,841 | 10/1935 | Coleman | 239/208 X |
| 2,355,629 | 8/1944 | Carrier | 257/133 |
| 2,487,287 | 11/1949 | Weber et al. | 257/133 |
| 3,113,624 | 12/1963 | Haggott et al. | 169/5 |
| 3,321,878 | 5/1967 | Brown et al. | 52/211 |
| 3,405,488 | 10/1968 | Nelson | 52/287 |
| 3,707,061 | 12/1972 | Collette et al. | 52/288 |
| 3,858,618 | 1/1975 | Kaufman | 138/149 |
| 4,050,205 | 9/1977 | Ligda | 52/357 |
| 4,079,786 | 3/1978 | Moling | 169/61 |
| 4,133,387 | 1/1979 | Tervidis | 239/282 X |
| 4,175,703 | 11/1979 | Valiant | 239/208 |
| 4,330,040 | 5/1982 | Ence et al. | 169/13 |
| 4,423,284 | 12/1983 | Kaplan | 52/221 X |
| 4,534,147 | 8/1985 | Cristell | 52/220 X |

*Primary Examiner*—Andres Kashnikow
*Assistant Examiner*—Patrick N. Burkhart
*Attorney, Agent, or Firm*—Jones, Askew & Lunsford

[57] ABSTRACT

A retrofit sprinkler system is installed into existing structures by means of a bracket which is mounted on the existing walls adjacent the ceiling to support flexible sprinkler pipe and related utilities. The bracket has a wall-mounting flange, front and bottom flanges for mounting a facade and soffit, and a central support opening. The support opening may be a closed circle or an open J-shape. In one embodiment the front flange may be adjustable toward and away from the existing wall to correct for irregularities in the existing wall.

2 Claims, 2 Drawing Sheets

RETROFIT SPRINKLER SYSTEM

BACKGROUND OF THE INVENTION

This invention relates generally to a fire protection sprinkler system, and more particularly concerns a sprinkler system which is retrofit into an existing building without the necessity of major renovation.

Over the past several years many states and municipalities have passed ordinances requiring the installation of fire protection sprinkler systems in high rate of occupancy buildings such as hotels, apartment buildings, and office buildings. Because such buildings have high rates of occupancy, it is important to the owners of such buildings that the installation of a retrofit sprinkler system not interfere with the continuing occupancy of the building during the installation.

In the past, sprinkler systems have been retrofit into buildings by simply removing portions of walls and ceilings and installing the necessary piping, sprinkler heads, wires, detectors, and alarms in the walls and ceilings and then replacing the walls and ceilings. Such work entails a substantial amount of dust, dirt, and noise thereby often rendering the portions of the building being retrofit uninhabitable during the retrofit process.

In order to alleviate the problems of such retrofit installation, sprinkler systems have been installed within cover-up boxes running along the corner of a hallway between the wall and ceiling. Such a procedure, while less expensive and disruptive than removal of walls and ceilings for access, still has required a substantial amount of construction work and disruption. Particularly, such cover-up boxes generally require that the piping for the sprinkler system first be installed by means of hangers attached to the ceiling of the hallway. Once the pipes and associated sprinkler heads, wires, detectors, and alarms have been installed from the ceiling hangers, then carpenters are required to install nailer strips along the ceiling and along the wall to provide support for the cover-up box which generally must be comprised of wooden boards or panels to insure nailability and a certain degree of integrity. The necessity of using wooden boards or panels along with the accompanying skilled carpentry labor obviously results in a substantial cost in installing the cover-up boxes for concealing the sprinkler system.

SUMMARY OF THE INVENTION

It is therefore an object of the present invention to provide an improved retrofit sprinkler system including the necessary cover-up boxes to hide the pipes, sprinkler heads, wires, detectors, alarms, and related utilities which are part of the retrofit sprinkler system.

It is likewise an object of the present invention to provide a retrofit sprinkler system which allows simple installation and which allows the contractor to use sheetrock or similar material to form the cover-up box instead of wooden boards or panels.

The foregoing objectives are accomplished by a retrofit sprinkler system which utilizes flexible pipe and is installed by means of a unique bracket, a number of which are attached to the walls adjacent the ceiling at spaced intervals, typically at the locations of the wall studs. The bracket has a planar rear flange so that it can be nailed or screwed to the wall. The bracket has a central support opening for containing and supporting the sprinkler pipe, wires, and other related utilities. The bracket also has a planar front mounting surface and a planar bottom mounting surface which allows the contractor to attach a facade of sheetrock or other similar materials to the front mounting surface of the bracket and a soffit of sheetrock or other similar material to the bottom mounting surface of the bracket to form a cover-up box.

In one preferred embodiment, the bracket has a J-shaped supporting opening which allows the brackets to be placed on the wall and the pipes and other related utilities to be placed onto the supporting opening from the open front portion of the J-shaped opening.

In another embodiment of the invention, the J-shaped bracket has a block which is adjustably attached to the main portion of the bracket. The block provides a front mounting surface which may be adjusted toward and away from the existing wall in order to compensate for any irregularities in the existing wall.

Other objects and advantages of the present invention will become apparent upon reading the following detailed description and upon reference to the drawings.

DETAILED DESCRIPTION OF THE INVENTION

While the invention will be described in connection with a preferred embodiment, it will be understood that we do not intend to limit the invention to that embodiment. On the contrary, we intend to cover all alternatives, modifications, and equivalents as may be included within the spirit and scope of the invention as defined by the appended claims.

Figure 1:
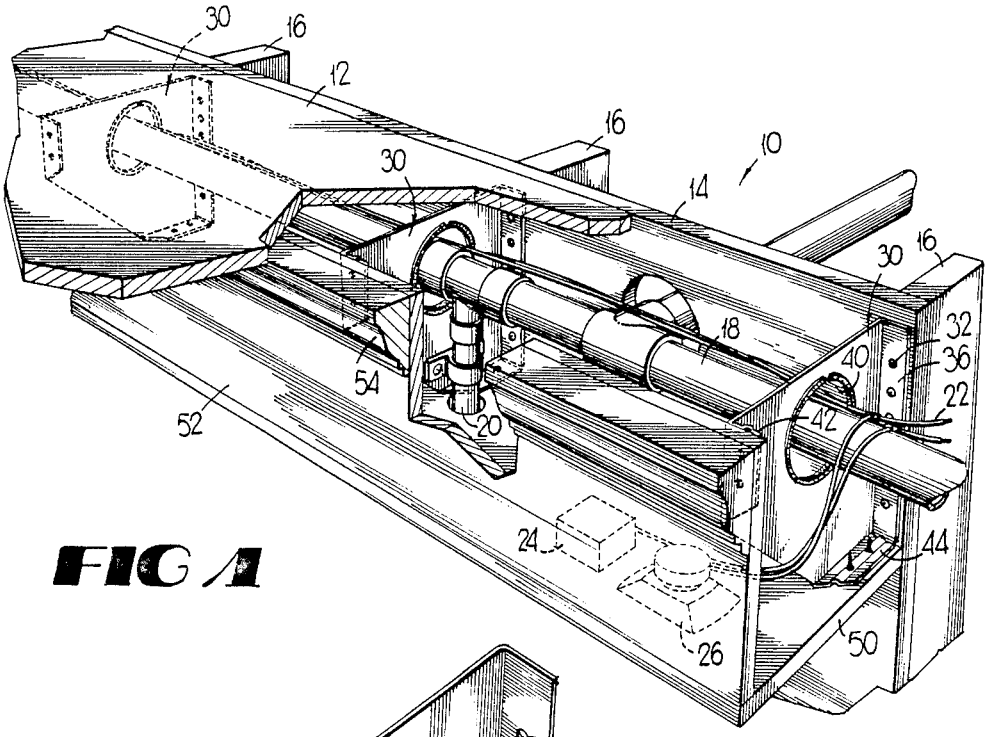
FIG. 1 is a perspective view with certain portions of the facade and soffit cut away to show the sprinkler system of the present invention.

Turning to FIG. 1, there is shown a retrofit sprinkler system 10 which is installed along the junction between an existing ceiling 12 and an existing wall 14. In many existing high-occupancy structures, the ceiling 12 is formed of reinforced concrete. The existing wall 14 is typically sheetrock nailed or screwed to wood or metal studs 16.

The retrofit sprinkler system 10 of the present invention allows installation of the necessary sprinkler utilities, i.e. pipe 18, sprinkler heads 20, wires 22, smoke and heat detectors 24, and alarms 26, without removal of the existing wall 14 or ceiling 12. Because the retrofit sprinkler system 10 is mounted onto the existing wall 14, there is no need to drill holes in the concrete ceiling 12 to support the sprinkler system utilities. It is also preferred that the pipe 18 be Underwriters Laboratory approved polybutylene. Such plastic pipe is flexible, which facilitates installation of the pipe in connection with the use of a unique bracket 30 for mounting the pipes.

Figure 2:
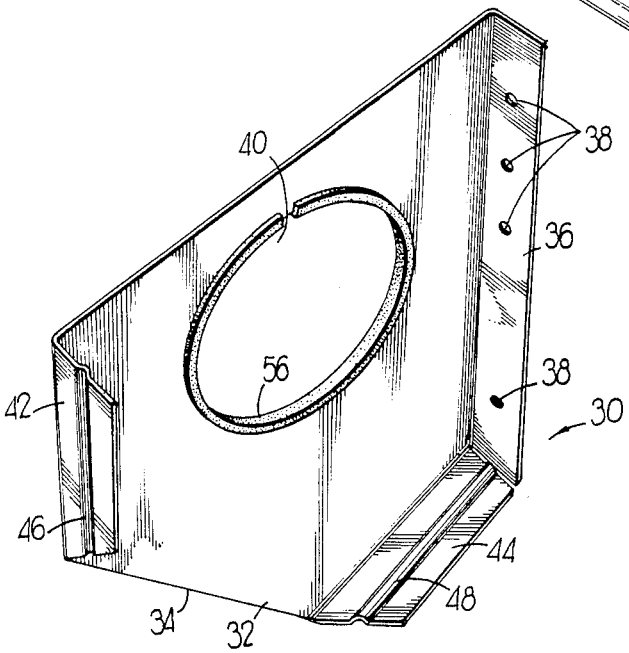
FIG. 2 is an enlarged perspective view of one bracket which is useful in connection with the present invention.

The retrofit sprinkler system is mounted onto the existing wall 14 by means of a number of brackets 30. One embodiment of bracket 30 is shown in FIG. 2. The bracket 30 is fabricated of sheet metal or plastic and comprises a central member 32 which is generally rectangular in shape with a corner 34 lopped off. The bracket 30 has a wall-mounting, planar flange 36 along the back of the bracket with mounting holes 38. As can be seen in FIG. 1, the bracket 30 is attached to the existing wall 14 by appropriate fasteners, such as nails or screws, inserted through holes 38 to engage studs 16 behind the wall 14.

The bracket 30 also has a planar front-mounting surface or front flange 42 and a similar planar bottom-mounting surface or bottom flange 44. The front flange 42 and the bottom flange 44 are integral with central member 32. The front flange 42 and the bottom flange 44 both have guide channels 46 and 48 respectively which provide centering for self-drilling screws which may be preferably used in attaching the soffit 50 to the bottom flanges 44 and the facade 52 to the front flanges. Once attached, the soffit and facade form a cover-up box for the sprinkler system utilities. Attachment of the facade and soffit may also be accomplished by drilling holes through the soffit and bottom flange and throught the facade and front flange and fastening the facade and soffit to the respective flanges with self-tapping screws.

The brackets 30 provide distributed support for both the facade and soffit along the length of the wall and ceiling junction. Consequently, the facade and soffit do not have to have any more strength than ordinary sheetrock. Likewise, wood or simulated wood paneling can be used without the necessity of additional backing or support beyond that provided by the brackets.

The cover-up box formed by the attached facade and soffit may be finished by adding molding 54 at the junction between the ceiling 12 and the facade 52. Molding (not shown) may likewise be added along the junciton between the wall 14 and the soffit 50. Alternatively, the facade and soffit may be prefabricated with the molding attached. In another embodiment the cover-up box may be prefabricated as a single continuous piece for quick installation on the brackets where the existing wall and ceiling are reasonably straight, plumb, and level.

The bracket 30 has a hole 40 in its central member 32. The hole 40 is lined with a soft grommet 56 which serves to protect the utilities that pass through and are supported within the hole of the bracket 30.

Figure 3:
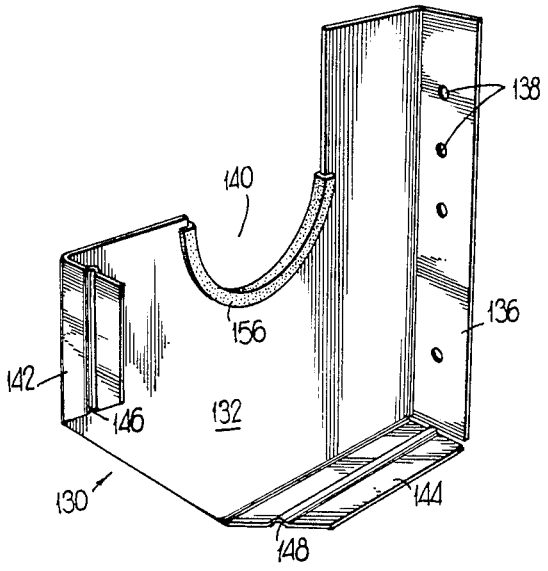
FIG. 3 is an enlarged perspective view of a second bracket which is useful in connection with the present invention.

In an alternative embodiment a bracket 130 in FIG. 3 may be used for the retrofit sprinkler system instead of the bracket 30 shown in FIG. 2. The bracket 130, like the bracket 30 (FIG. 2), has a central member 132 of sheet metal or plastic, integral mounting flange 136 with mounting holes 138, front flange 142 with fastener guide channel 146, and bottom flange 144 with fastener guide channel 148. Bracket 130, unlike bracket 30, has a support opening 140 in the shape of the letter J with a protective grommet 156 along its lower curve for supporting the sprinkler system utilities. The bracket 130 with its J-shaped opening 140 provides easy installation of the sprinkler pipe which can be inserted into the opening through the front instead of threading the pipe from bracket to bracket as is required with bracket 30 (FIG. 2). Consequently, the pipe can be completely assembled on the floor and then lifted into place on the brackets. The flexible plastic pipe further facilitates placing the pre-assembled pipe onto the bracket 130. The facades and soffits are attached to bracket 130, as previously described concerning bracket 30 (FIG. 2).

Figure 4:
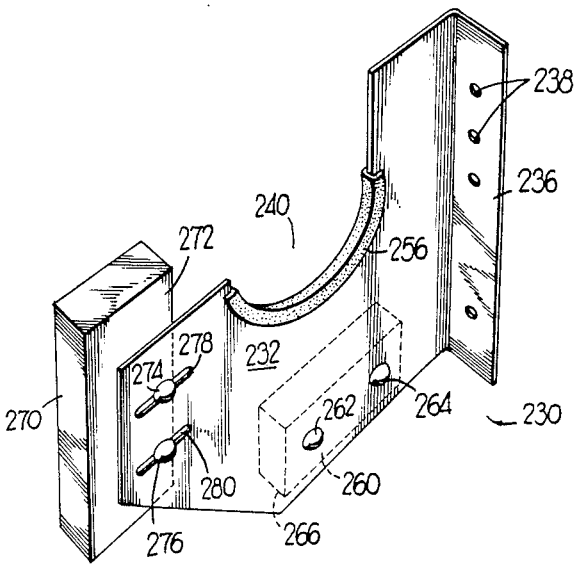
FIG. 4 is an enlarged perspective view of a third bracket which is useful in connection with the present invention.

Another embodiment of the bracket 230 is shown in FIG. 4. Bracket 230, like bracket 30 (FIG. 2), has a central member 232 of sheet metal or plastic and an integral mounting flange 236 with mounting holes 238. The bracket 230, like bracket 130 (FIG. 3), has a J-shaped opening 240 with a protective grommet 256 for supporting the sprinkler utilities. The bracket 230 has a planar bottom mounting surface 266 which is provided by a wood block 260 attached by screws 262 and 264 to the central member 232 adjacent the bottom of the bracket 230. The wood block 260 provides a mounting surface 266 to which the soffit may be attached by means of a screw or nail. The bracket 230 also has a planar front mounting surface 270 which is provided by wood block 272. The wood block 272 is secured to the central member 232 by means of screws 274 and 276 which engage slots 278 and 280 respectively in central member 232. The slots 278 and 280 allow the wood block to be slid toward or away from the existing wall in order to compensate for irregularities in the line of the existing wall. Consequently, the wood block 272 can be adjusted on each bracket 232 mounted on the walls so that the surfaces 270 on each succeeding bracket 280 are coplanar, thus facilitating the attachment of the facade in a straight line.

I claim:

1. A retrofit sprinkler system, comprising:

a. a number of brackets, each comprising a central member having a wall-mounting flange attached thereto for mounting the bracket to a wall adjacent the ceiling, a support opening in the central member, said support opening being J-shaped and oriented for access adjacent the front mounting surface, wherein the front mounting surface is slideably adjustable toward and away from the wall-mounting flange, a planar front mounting surface, and a planar bottom mounting surface;

b. flexible pipe, with sprinkler heads attached thereto and connected to a water source, the flexible pipe being supported in the openings of the brackets;

c. a facade fastened to the front mounting surfaces; and d. a soffit having sprinkler head openings fastened to the bottom mounting surfaces.

2. The sprinkler system of claim 1, wherein the facade and soffit are prefabricated together.

* * * * *